United States Patent [19]

Godbey

[11] 4,396,063

[45] Aug. 2, 1983

[54] PROCESS AND SYSTEM FOR PROVIDING MULTIPLE STREAMS OF WET STEAM HAVING SUBSTANTIALLY EQUAL QUALITY FOR RECOVERING HEAVY OIL

[75] Inventor: John K. Godbey, Dallas, Tex.

[73] Assignee: Mobil Oil Corporation, New York, N.Y.

[21] Appl. No.: 321,838

[22] Filed: Nov. 16, 1981

[51] Int. Cl.[3] ..... E21B 36/00; E21B 43/24

[52] U.S. Cl. ..... 166/250; 166/57; 166/64; 166/272; 166/303

[58] Field of Search ..... 166/303, 272, 250, 252, 166/64, 57, 52, 75 R

[56] References Cited

U.S. PATENT DOCUMENTS

| | | | |
|---|---|---|---|
| 3,125,072 | 3/1964 | Brandt et al. | 166/272 X |
| 3,193,009 | 7/1965 | Wallace et al. | 166/303 X |
| 3,421,583 | 1/1969 | Koons | 166/303 X |
| 3,499,488 | 3/1970 | Haynes, Jr. et al. | 166/303 X |
| 3,923,288 | 12/1975 | King | 366/336 |
| 4,120,357 | 10/1978 | Anderson | 166/272 |
| 4,299,278 | 11/1981 | Beehler | 166/303 X |
| 4,322,603 | 3/1982 | Bright | 166/303 X |

FOREIGN PATENT DOCUMENTS

| | | | |
|---|---|---|---|
| 1022064 | 12/1977 | Canada | 166/272 |

OTHER PUBLICATIONS

Farouq Ali, "Wet Steam For Thermal Recovery", *Producers Monthly*, Feb. 1966, pp. 2 and 4–7.

*Primary Examiner*—Stephen J. Novosad

*Attorney, Agent, or Firm*—Charles A. Huggett; James F. Powers, Jr.; Lawrence O. Miller

[57] ABSTRACT

A system and method for splitting a stream of wet steam into at least two streams of equal quality for injection into separate wells wherein the steam is utilized as a thermal recovery fluid in an in situ oil recovery process. The method comprises generating wet steam having a vapor phase and a liquid phase, thoroughly mixing the two phases of the steam in a motionless mixer, immediately passing the mixed wet steam into a flow splitter which splits the stream of wet steam into at least two streams of wet steam having equal quality, and injecting each stream of wet steam into separate wells at a controlled rate.

11 Claims, 3 Drawing Figures

PROCESS AND SYSTEM FOR PROVIDING MULTIPLE STREAMS OF WET STEAM HAVING SUBSTANTIALLY EQUAL QUALITY FOR RECOVERING HEAVY OIL

BACKGROUND OF THE INVENTION

The present invention relates to a system and method of generating wet steam of known quality and splitting the generated wet steam into at least two streams of wet steam have substantially equal quality and injecting the wet steam under a controlled rate into separate wells used in the recovery of oil from a subterranean, viscous oil-containing formation.

Steam injection or steam flooding has gained substantial recognition in the art as a preferred method for recovering viscous or heavy oil from subterranean oil-containing formations. In one oil recovery process, steam is injected into one or more wells for a period of time, after which steam injection is terminated and oil is pumped to the surface of the earth through the same well or wells as were used for injecting the steam in the formation which is sometimes referred to as "push-pull" steam stimulation. In another recovery process using steam, the steam is injected into the formation via an injection well and passes through the formation displacing oil toward a spaced-apart production well from which oil is recovered.

These viscous oil recovery processes utilizing steam generally involve the use of a single steam generator and a plurality of wells for steam injection. The steam generated is preferably wet steam with sufficient liquid content to prohibit deposition of salts in the steam generating apparatus. The quality of the produced wet steam is a measure of the weight percent which is in the vapor phase. Thus, 80% quality steam means that 80% of the steam on the basis of weight is vapor with the remaining 20% being liquid phase.

When the flow of wet steam from a steam generator is split into two streams using a convention "Tee," the two streams will not have the same quality. The change in steam quality by splitting in known to be effected by the two-phase flow regime just ahead of the flow splitting. The flow may change from bubble flow to stratified flow to slug flow to annular flow as the liquid to vapor ratio changes from high to low. Since the heat content or enthalpy of the vapor phase portion of the steam is substantially higher than the liquid phase, the heat content of each stream is therefore different which makes it difficult to control and measure the amount of heat injected into the wells from a split stream.

In view of the foregoing discussion, it can be appreciated that there is a substantial, unfulfilled need for a method of splitting a stream of wet steam into two or more equal quality streams for injection into separate wells used in an oil recovery process.

SUMMARY OF THE INVENTION

The present invention relates to a system and method for generating wet steam by a single steam-generating apparatus, splitting the wet steam into at least two separate streams of equal quality and introducing each stream of wet steam into separate wells used for the recovery of oil from subterranean, viscous oil-containing formations. Wet steam is generated in a steam-generating apparatus and the quality of the wet steam is measured by means of an orifice meter along with its temperature and pressure. The wet steam is then passed through a motionless mixer whereby the wet steam comprising a vapor phase and a liquid phase is thoroughly mixed or homogenized. Thereafter, the mixed wet steam is introduced into the input leg of a "wye" or multiple pipe junction equally spaced symmetrically around the axis of the motionless mixer whereby the wet steam is split into two or more streams having substantially equal quality. The two or more equal-quality streams of wet steam are then injected into separate wells at a controlled flow rate and known heat content. Since the quality of the steam injected into each injection well is substantially equal, the amount of heat injected into the oil-containing formation for the recovery of oil therefrom via each well is more effectively measured and controlled.

DESCRIPTION OF THE PREFERRED EMBODIMENT

Figure 1:
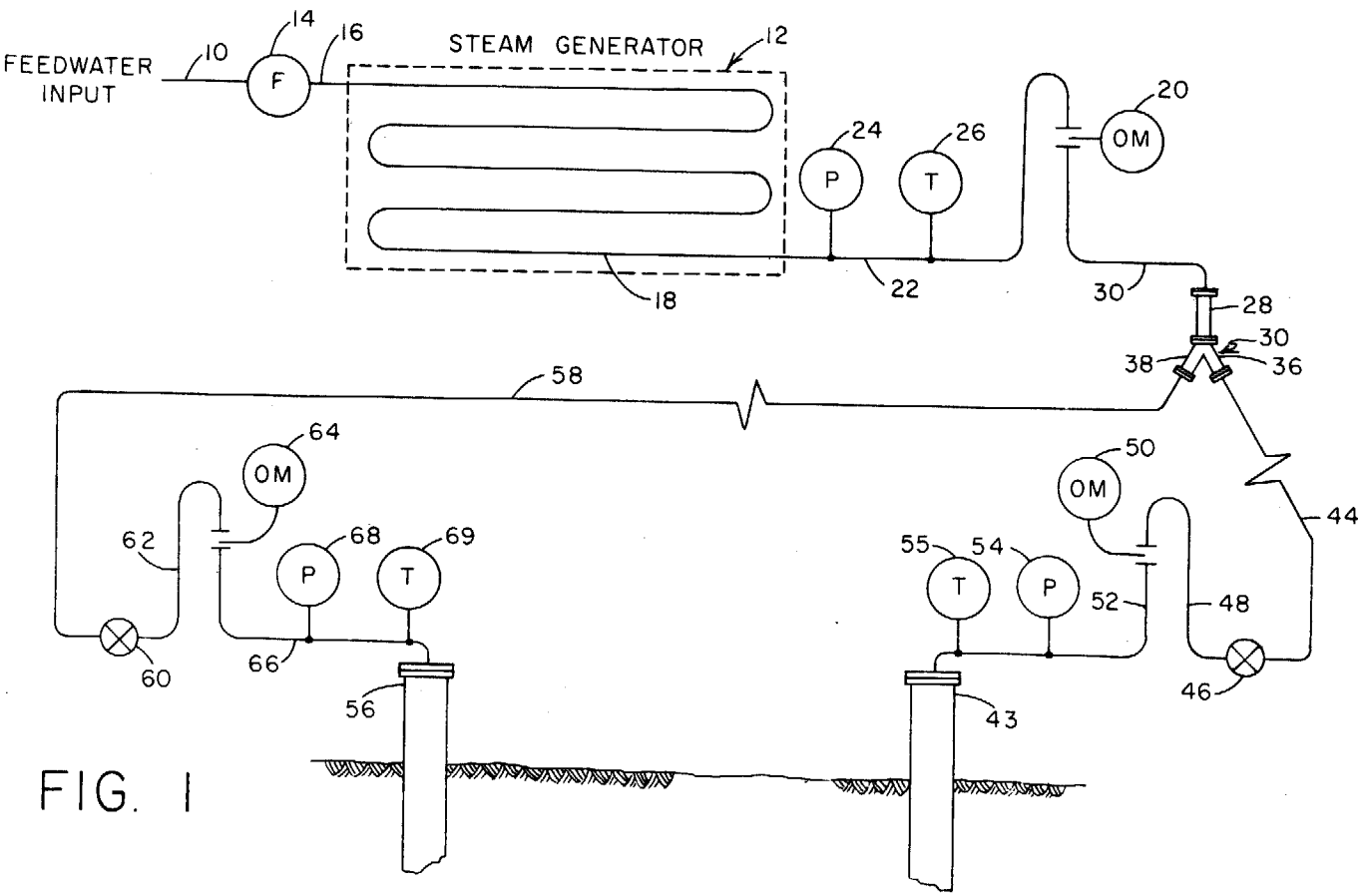
FIG. 1 is a diagrammatic view of a steam generator, a motionless mixer and a "wye" conduit flow splitter for splitting the flow of stream into two equal quality streams for injection into separate injection wells.

Referring to FIG. 1, a source of raw water for making wet steam is illustrated by the number 10 which is supplied to a steam generator 12 by way of a pump (not shown), through a flow meter 14 and through conduit 16. The steam generator 12 is provided with steam generating tubes 18. These tubes are arranged in a once through flow arrangement. The quality of the wet steam is preferably not more than 80% but may be within the range of 50 to about 85%. From the steam generating tubes 18, the wet steam is supplied to an orifice flow meter 20 through conduit 22. The orifice flowmeter is located on the downflow side of a vertical loop in the flowline to assure that the wet steam flows and does not stagnate in the meter. Means are provided at 24 and 26 for measuring the pressure and temperature, respectively, of the wet steam flow through conduit 22 into orifice meter 20 so as to determine the enthalpy of the wet steam. The preferred type of orifice meter 20 used in this system is a sharp edged orifice of the type described in the article by Russell James; Metering of Steam-Water Two Phase Flow by Sharp-Edged Orifices, Proceedings, Institution of Mechanical Engineers, London, Vol. 180, Pt. 1, No. 23, 1956–66, p. 549, the disclosure of which is hereby incorporated by reference. Also, it is preferred that flange taps be used with an orifice plate sized so that the ratio of the orifice to the pipe diameter is within the range of 0.65 to 0.75.

The flow of wet steam from the steam generator 12 after passing through the orifice meter 20 to measure the quality of the wet steam is then introduced into a motionless mixture 28 via conduit 30. The preferred motionless mixer 28 suitable for this purpose is disclosed in U.S. Pat. No. 3,923,288 to King, the disclosure of which is hereby incorporated by reference. The motionless mixer 28 thoroughly mixes or homogenizes the vapor and liquid phases of the wet steam. For thorough mixing of the wet steam, the input Reynolds number of the wet steam entering the motionless mixer 28 must be at least 500.

Figure 2:
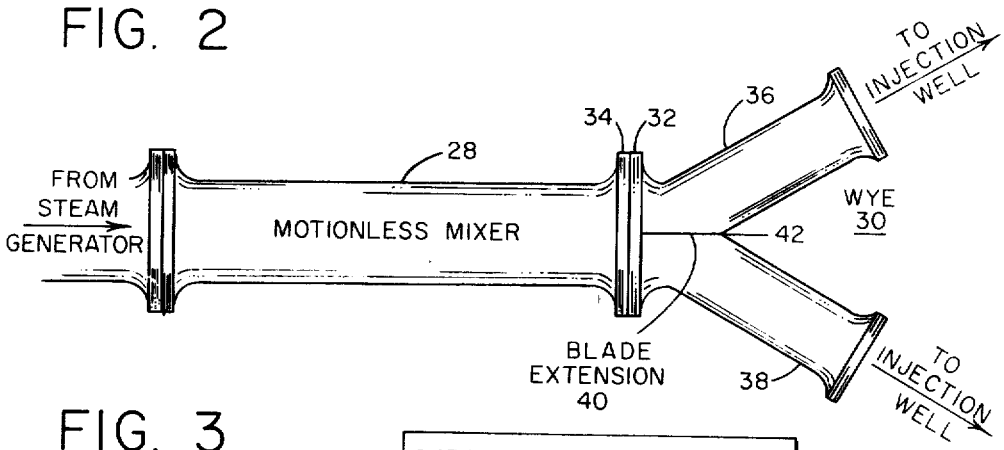
FIG. 2 is an enlarged diagrammatic view of the motionless mixer and "wye" conduit flow splitter of FIG. 1.

The output end of the motionless mixer 28 is connected to the input leg of a "wye" conduit flow splitter 30. Referring to FIG. 2, the input leg of the "wye" conduit flow splitter 30 has a flange 32 which is secured to the flanged end 34 of the motionless mixer 28 by bolts (not shown). The "wye" conduit flow splitter 30 includes divergent conduits 36 and 38 and a blade extension member 40 that extends from flange 32 to the confluence of conduits 36 and 38 at 42 for immediately splitting the thoroughly mixed wet steam from the motionless mixer 28 into two separate streams having substantially equal steam quality that pass through conduits 38 and 40.

Referring again to FIG. 1, the wet steam flowing through conduit 36 of the flow splitter 30 is supplied to a well 43 by way of conduit 44, a flow control valve 46, through conduit 48, an orifice meter 50, and through conduit 52 connected to the well. Prior to entering well 43, means are provided at 54 and 55 for measuring the pressure and temperature respectively of the wet steam entering the well so as to determine its enthalpy or heat content.

The wet steam flowing through conduit 38 of the flow splitter 30 is supplied to a separate well 56 by way of conduit 58, a flow control valve 60, through conduit 62, an orifice meter 64, and through conduit 66 connected to the well. Prior to entering well 56, means are provided at 68 and 69 for measuring the pressure and temperature respectively of the wet steam entering the well so as to determine its enthalpy or heat content.

Flow control valves 46 and 60 in each leg of the system are preferably globe valves equipped with control trim so that fine adjustment of the flow rate to each well can be made. Flange tapped orifice plates are preferably used in orifice meters 50 and 64 wherein the orifice opening is sized so that the ratio of orifice to pipe diameter is within the range of 0.65 to 0.75. Both of these orifice meters are also located on the downflow side of a vertical pipe loop. Since the quality of steam entering the orifice flowmeters 50 and 64 is known, these meters are used to measure the actual flowrate into each well. This provides the other necessary parameter needed to calculate the total enthalpy into each well in Btu's/hr.

Wells 43 and 56 penetrate a subterranean, viscous oil-containing formation thereby allowing the wet steam to enter the formation to heat the oil reducing its viscosity and stimulate its recovery from the formation by various methods known in the art.

The quality of the wet steam leaving steam generator 12 utilizing the orifice meter 20 is determined in accordance with the technique described by Thomas M. Wilson is his paper entitled "Steam Quality and Metering" which appears in the Journal of Canadian Technology, Vol. 15, No. 2, April-June, 1976, p. 33, the disclosure of which is hereby incorporated by reference.

The orifice meter correlation used by Wilson was developed by Russell James, mentioned above, who devised this correlation to analyze the flow from the steam fields of Wairakei, New Zealand. In accordance with this technique, the standard equation for single-phase flow through a sharp-edged orifice plate is:

$$W_h = C_o\left(\frac{h_w}{v}\right)^{\frac{1}{2}} \tag{1}$$

where $W_h$ = mass throughput rate—lb/hr $h_w$ = pressure drop across the orifice—inches of water $v$ = specific volume—$ft^3$/lb $C_o$ = orifice meter factor—which includes:

- a proportionality constant
- meter geometry
- fluid properties influencing Reynolds' number
- influence of temperature on meter dimensions
- empirically determined coefficients for standard conditions Normal practice when measuring high quality steam (95 to 100%) is to adjust the specific volume term in equation (1) to account for the degree of wetness. The specific volume of a two-phase system is:

$$V_{fg} = XVg + (1-x)V_f \tag{2}$$

where $X$ = steam quality—fraction of mass in vapor phase $V_g$ = specific volume of saturated steam—$ft^3$/lb $V_f$ = specific volume of saturated water—$ft^3$/lb This correction is adequate for very high qualities, but it has been found to be inaccurate for the low qualities used in th field. James found by experiment that equation (1) could be used directly if the specific volume term is calculated from equation (2) by using an apparent quality term that is related to the true quality by:

$$x_{\text{apparent}} = X^{1.5}_{\text{true}}$$

Then, equation (1) becomes:

$$W_h = C_o\left(\frac{h_w}{X^{1.5}\,V_g + (1 - X^{1.5})V_f}\right)^{\frac{1}{2}}$$

Solving for the quality:

$$X = \left(\frac{\frac{C_o^2\,h_w}{W_n^2} - V_f}{V_g - V_g}\right)^{\frac{1}{2}}$$

The quality can then be calculated directly when the mass throughput rate is known independently. The mass throughput is easily determined by measurement of the mass input in the feedwater line to the steam generator. $C_o$ is determined as if all the fluid flowing was saturated vapor, the pressure drop, $h_w$, is measured and $V_g$ and $V_f$ are determined from steam tables at the operating pressure level of the orifice.

From the foregoing, it should be readily apparent that the system hereinbefore described permits (1) a reliable and accurate method of measuring wet steam quality; (2) a method of splitting the output of a wet steam generator into two streams of substantially equal quality; and (3) effectively controlling and measuring the amount of heat introduced into the oil-containing formation via each well measured in terms of Btu's per hour.

It will be apparent that the present method may be carried out by employing more than one flow splitter wherein both or one of the streams passing from the first flow splitter may be split into two additional streams that are then injected into separate wells. Each additional flow splitter must be preceded by a motionless mixer to assure that the split streams of wet steam are of substantially the same quality. The number of flow splitters used will depend upon the well pattern used in a particular field.

In still another embodiment of the invention, the motionless mixer and flow splitter may be modified to provide for more than two split streams of steam of equal quality. For example, the mixed wet steam discharged from the motionless mixer may be split into three streams of wet steam having equal quality employing a flow splitter with three symetrically arranged diverging conduits.

ILLUSTRATIVE FIELD EXAMPLE

Figure 3:
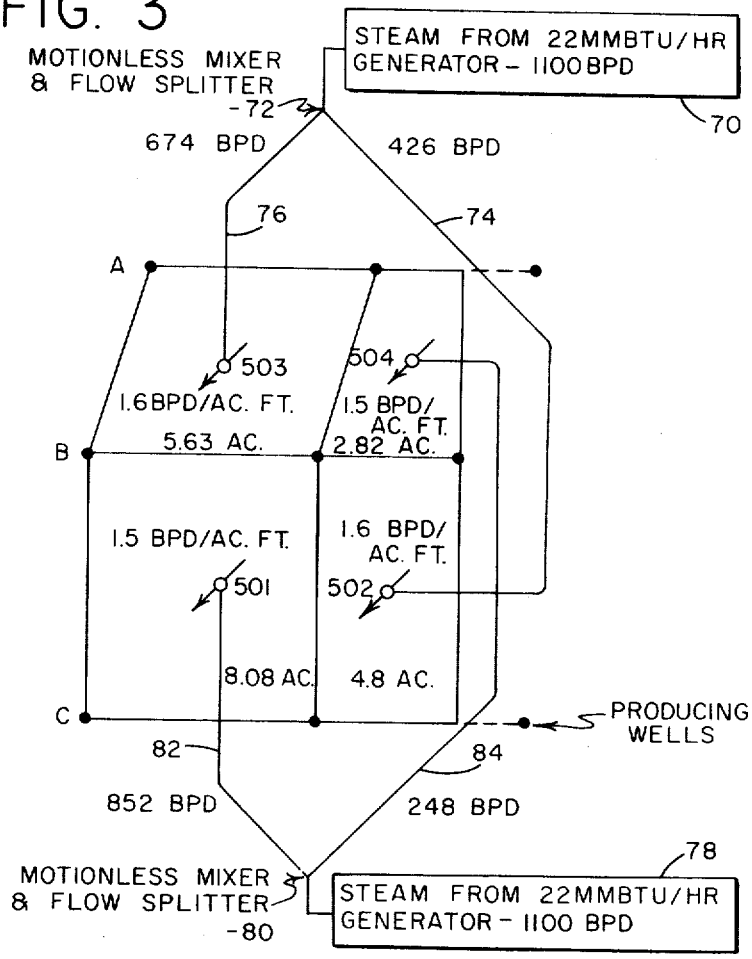
FIG. 3 is an illustration of a well pattern in an oil field and arrangement of splitting the flow of steam from two steam generators which may be employed in carrying out the present invention.

This invention may be better understood by reference to the following example which is offered only as an illustrative embodiment of the invention and is not intended to be limited or restrictive thereof. FIG. 3 shows a plurality of five-spot well patterns for carrying out the present invention. In FIG. 3, an injection well is represented by a circle with a first quadrant arrow and a production well is represented by a solid circle. As shown in FIG. 3, this integrated pattern comprises four five-spot patterns, each of which comprises a central injection as well as indicated by reference numbers 501, 502, 503, and 504 and peripheral production wells surrounding each injection well in rows A, B, and C. A summary of the known parameter for each injection well is shown below:

Injection Well 501:
- Area = 8.08 acres
- Net Pay = 70.1 feet
- Volume = 566.41 acre-ft Injection Well 502:
- Area = 4.81 acres
- Net Pay = 55.4 feet
- Volume = 266.47 acre-ft Injection Well 503:
- Area = 5.63 acres
- Net Pay = 75.0 feet
- Volume = 422.25 acre-ft Injection Well 504:
- Area = 2.82 acres
- Net Pay = 58.4 feet
- Volume = 164.69 acre-ft As shown in FIG. 3, wet steam from a single steam generator 70 passes through a motionless mixer and a flow splitter generally indicated at 72, which splits the single stream of wet steam into two streams 74 and 76 of wet steam having substantially equal quality that are then injected into injection wells 502 and 503. A second steam generator 78 generates a stream of wet steam that passes through a motionless mixer and a flow splitter generally indicated at 80, which splits the single stream of wet steam into two streams 82 and 84 of wet steam having substantially equal quality that are injected into injection wells 501 and 504. Each steam generator 70 and 78 is designed to generate 22 MM Btu/Hr of wet steam at a pressure of 1500 psig, a throughput of 1100 BPD and a quality of 80%.

The flow into each well is monitored by measuring the pressure drop across an orifice located in the downflow leg of the flow loop at each wellhead. All of the flow orifices are of the same size. Since the wet steam quality and orifice size at each well is the same, the square root of the pressure drop at each wellhead will be proportional to the actual flow rate. By means of a flow control valve in each line to the injection wells, the flow rate ratio of each pair of injection wells can be adjusted to conform to the volume of each well with the total volume of wet steam totaling 1100 BPD to each pair of injection wells.

In wells 503 and 502, the ratio, $R_1$, of the flow rates will be the ratio of the effective acre-ft of each well to be flooded:

$$R_1 = \frac{422.25^{503}}{266.47^{502}} = 1.58.$$

In wells 501 and 504, the ratio, $R_2$, of the flow rate will be:

$$R_2 = \frac{566.41^{501}}{164.96^{504}} = 3.44.$$

These ratios are taken in each case so that the result is always a number greater than one. Since the square root of the differential pressure drop across the orifice at each well indicates the actual flow rate, then the ratios of the square roots of the respective $h_w$'s should equal to the calculated ratios. In equation form:

$$\frac{W_h^{503}}{W_h^{502}} = \sqrt{\frac{h_w^{503}}{h_w^{502}}} = R_1, \text{ and } \frac{W_h^{501}}{W_h^{504}} = \sqrt{\frac{h_w^{501}}{h_w^{504}}} = R_2.$$

These equations assume that the orifice factor and wet steam quality are the same in each case. the total volume being injected in each pair of wells should equal the generator throughput. Thus:

$$W_h^{503} + W_h^{502} = 1100\ BPD \text{ and } W_h^{501} + W_h^{504} = 1100\ BPD$$

$$\text{Since } \frac{W_h^{503}}{W_h^{502}} = 1.58, \text{ then } \begin{matrix} W_h^{503} = 674\ BPD \\ W_h^{502} = 426\ BPD \end{matrix} \quad 1.6\ BPD\text{-}Ac.\ Ft.$$

The other pair of injectors will result in:

$$\frac{W_h^{501}}{W_h^{504}} = 3.44, \text{ then } \begin{matrix} W_h^{501} = 852\ BPD \\ W_h^{504} = 248\ BPD \end{matrix} \quad 1.5\ BPD\text{-}Ac.\ Ft.$$

From the above results, it can be seen that the amount of heat injected into a pair of injection wells can be effectively controlled in terms of Btu's per acre-foot thickness of oil-containing formation utilizing split streams of steam having substantially equal quality.

It will be understood that certain features and alterations of disclosed steps may be employed without departing from the spirit of the present invention. This is contemplated by, and is within the scope of, the appended claims. Additionally, it is intended that the present description is to be taken as a means of illustration, and not as a limitation, of the present method and system.

What is claimed is:

1. A method for injecting steam into two or more wells comprising:

(a) passing water into a steam generator at a measured flowrate to produce wet stream comprising a vapor phase and a liquid phase;

(b) measuring the quality of said wet steam;

(c) passing said wet steam through a motionless mixer whereby the vapor phase and the liquid phase of the wet steam are thoroughly mixed;

(d) passing the mixed wet steam into a flow splitter whereby the wet steam introduced into the flow splitter is split into at least two separate streams of wet steam having substantially the same quality;

(e) measuring the pressure, temperature, and flowrate of said separate streams of wet steam passing from the flow splitter so as to determine the enthalpy of each stream; and (f) providing means for regulating the flow rate of said streams of wet steam and injecting said streams into separate wells.

2. The method of claim 1 wherein the flow splitter during step (d) comprises a wye branched conduit having an input section and two diverting branch sections whereby the steam introduced into the flow splitter is split into two separate streams of wet steam having substantially the same quality.

3. The method of claim 1 wherein the quality of the wet steam generated during step (a) is 80%.

4. The method of claim 1 wherein the quality of wet steam generated during step (a) is within the range of 50 and 85%.

5. The method of claim 1 wherein the Reynolds number of the wet steam flowing into the motionless mixer during step (c) is at least 500.

6. The method of claim 1 further comprising passing at least one of said streams of wet steam flowing from said flow splitter through an additional motionless mixer and flow splitter to produce at least two additional streams of wet steam having substantially the same quality.

7. A system for assisting the recovery of oil from a subteranean, viscous oil-containing formation wherein wet steam is injected into the formation via two or more wells to promote the flow of oil therefrom comprising:

(a) a steam generator for generating wet steam comprising a vapor phase and a liquid phase and means for supplying water into said steam generator at a known flowrate;

(b) means for measuring the quality of said wet steam;

(c) means for thoroughly mixing the liquid phase and the vapor phase of said wet steam;

(d) means for splitting the flow of said wet steam from the mixing means into at least two separate streams of wet steam having substantially equal quality;

(e) means for injecting each of said streams of substantially equal quality wet steam into separate wells;

(f) means for measuring the pressure, temperature, and flowrate of each of said streams of wet steam of substantially equal quality prior to injection into said separate wells; and (g) means for regulating the flow rate of each of said streams of wet steam of having substantially equal quality prior to injection into said separate wells.

8. A system of claim 7 wherein the means for splitting the flow of wet steam during step (d) comprises a wye-branched conduit having an input section and two diverging branch sections.

9. The system of claim 7 wherein the means for measuring the ability of the wet steam during step (b) comprises an orifice meter.

10. The system of claim 7 wherein the means for mixing the wet steam during step (c) comprises a motionless mixer apparatus.

11. The system of claim 7 further comprising means for thoroughly mixing at least one of said streams of wet steam flowing from said flow splitter and means for splitting the flow of said mixed steam of wet steam into at least two separate streams of wet steam having substantially equal quality.

* * * * *